US006132296A

United States Patent [19]

Mansfield

[11] Patent Number: 6,132,296

[45] Date of Patent: Oct. 17, 2000

[54] APPARATUS FOR TREATMENT OF SURFACES

[76] Inventor: Philip Anthony Mansfield, Ashtree House, 25 Eastfield Lane, Welton, Lincoln LN2 3NA, United Kingdom

[21] Appl. No.: 09/135,189

[22] Filed: Aug. 17, 1998

[30] Foreign Application Priority Data

Aug. 19, 1997 [GB] United Kingdom ..... 9717451

[51] Int. Cl.[7] ..... B24C 3/06

[52] U.S. Cl. ..... 451/92; 451/354

[58] Field of Search ..... 451/2, 5, 75, 87, 451/88, 89, 92, 97, 95, 94, 354, 64, 91

[56] References Cited

U.S. PATENT DOCUMENTS

| | | | |
|---|---|---|---|
| 3,015,913 | 1/1962 | Anderson, Sr. . | |
| 3,034,262 | 5/1962 | Pawlson . | |
| 3,262,228 | 7/1966 | Schenck . | |
| 3,380,196 | 4/1968 | Mabille . | |
| 3,385,006 | 5/1968 | Miller et al. . | |
| 3,608,968 | 9/1971 | Burnett . | |
| 3,691,689 | 9/1972 | Goff . | |
| 3,864,876 | 2/1975 | Diehn . | |
| 3,877,175 | 4/1975 | Snyder . | |
| 3,900,968 | 8/1975 | Shigyo . | |
| 3,900,969 | 8/1975 | Diehn . | |
| 4,052,820 | 10/1977 | Bergh . | |
| 4,095,378 | 6/1978 | Urakami . | |
| 4,149,345 | 4/1979 | Atsuchi . | |
| 4,286,417 | 9/1981 | Shelton | 451/92 |
| 4,377,922 | 3/1983 | Bergh . | |
| 4,377,923 | 3/1983 | Bergh . | |
| 4,377,924 | 3/1983 | Bergh . | |
| 4,545,156 | 10/1985 | Hockett | 451/92 |
| 5,138,800 | 8/1992 | Janusz | 451/92 |
| 5,161,337 | 11/1992 | Swain | 451/92 |
| 5,240,503 | 8/1993 | Levy et al. | 451/92 |
| 5,716,261 | 2/1998 | Watkin | 451/92 |
| 5,730,646 | 3/1998 | Watkin | 451/92 |

FOREIGN PATENT DOCUMENTS

| | | |
|---|---|---|
| 0 574 771 | 12/1993 | European Pat. Off. . |
| 0 631 848 | 12/1993 | European Pat. Off. . |
| 41 43 113 | 7/1992 | Germany . |
| 195 14 751 | 10/1996 | Germany . |
| WO/97/12725 | 4/1997 | Japan . |
| 332849 | 7/1930 | United Kingdom . |
| 1256921 | 12/1971 | United Kingdom . |

*Primary Examiner*—Derris H. Banks
*Attorney, Agent, or Firm*—Seidel, Gonda, Lavorgna & Monaco, PC

[57] ABSTRACT

The machine consists of a blast housing, a reclaim duct, a reclaim hopper and a support framework. In use, the machine is supported on a horizontal surface over which it is driven and carries out a shot blasting or other operation on an adjacent vertical surface. The blast housing contains a centrifugal throwing wheel which is driven by an electric motor, whereby particulate material introduced into the cage is projected at high speed onto the surface. The reclaim duct receives particulate material, together with debris produced by the action of the material on the surface which rebounds from the surface, and feeds the debris and particulate material to the reclaim hopper. The central axis of the reclaim duct follows a three-dimensionally curved path which describes an upward turn through approximately 90° and also an arc of about 145° in an imaginary horizontal plane perpendicular to the vertical surface. The upper end of the reclaim duct is connected to the reclaim hopper. The particulate material which is returned to the hopper is separated from the debris from the surface by air wash, and returned to the throwing wheel.

15 Claims, 3 Drawing Sheets

APPARATUS FOR TREATMENT OF SURFACES

FIELD OF THE INVENTION

The present invention relates to apparatus for the treatment of surfaces, in particular upwardly-extending surfaces, which term includes vertical surfaces.

The surface treatment which is carried out by apparatus to which the invention relates involves the projection of particulate material onto the surface and the subsequent recovery of some or all of the particulate material which rebounds from the surface, the recovered material then being re-used by the apparatus. The particulate material may be, for example, steel shot, steel grit, sand or any other suitable particulate material.

BACKGROUND TO THE INVENTION

Apparatus for use in treating upwardly-extending surfaces, including vertical surfaces, has in the past included apparatus which is constructed to be moved in a vertical direction up and down the surface. The particulate material in some cases is projected upwardly at an acute angle to the surface, as in the apparatus of U.S. Pat. No. 3,900,969; in other cases, the material is projected downwardly at an acute angle to the surface.

It is an object of the present invention to provide a machine which can be used to treat a vertical surface and attain a gravity-feed of rebounding material to a separating means of the apparatus whilst using a substantially horizontal direction impingement of the particulate material onto the surface.

SUMMARY OF THE INVENTION

The present invention provides an apparatus suitable for the treatment of a vertical surface, the apparatus comprising a movable housing having an opening therein for facing a surface to be treated, means within the housing for projecting particulate material out through the opening onto a said surface, and a rebound duct extending from the opening and positioned to receive particulate material rebounding from the surface after having been projected onto the surface by the material-projection means, the rebound duct extending from the opening to a means for separating rebounding particulate material from other material and returning the separated particulate material under gravity to the material-projection means, wherein the material-projection means is arranged to direct incident material onto a vertical surface in a direction having substantially no vertical component and the rebound duct is shaped to constrain rebounding material to follow a path whereby the rebounding material is fed to the separating means for return under gravity to the material-projection means.

It will be understood that, throughout this specification, the apparatus of the invention is described in operation in the treatment of a vertical surface. The apparatus of the invention may also be used in the treatment of upwardly-extending surfaces generally, provided the surface has a sufficient vertical component for operation of the apparatus.

Preferably, the rebound duct of an apparatus according to the invention has a spiral configuration which diverts the path of the rebounding material from the horizontal direction, in which it rebounds from the surface being treated, upwardly to an inlet of the separating means.

The shape of the spiral reclaim duct may be such that the direction of the rebounding material is turned through at least 90°, the spiral thus constituting at least one quarter of the complete turn.

The separating means conveniently includes a feed hopper into which the rebounding material issuing from the rebound duct falls under gravity.

Advantageously, the apparatus of the present invention includes rolling means, for example wheels, for contacting the surface to be treated. Alternatively or additionally, the apparatus may include means for support of the apparatus on a horizontal surface adjacent the surface to be treated, such means preferably constituting rolling means, of which wheels are again an example.

The rolling means for supporting the apparatus on a horizontal surface may have associated drive means, for example an electric motor.

Advantageously, the apparatus includes means whereby the height of the opening in the housing relative to a horizontal support surface can be selectively adjusted.

The adjustment means may comprise the mounting of the housing, reclaim duct and separating means as a sub-assembly which is movable relative to a support framework, and means for securing the sub-assembly at a selected position relative to the support framework.

The adjustment means conveniently comprise a shaft on which the sub-assembly is slidably supported on slide bearings, and means for preventing relative sliding movement between the shaft and the bearings when a selected relative position has been achieved.

DESCRIPTION OF THE PREFERRED EMBODIMENT

An embodiment of the invention will now be described by way of example and with reference to the accompanying drawings, in which.

Figure 1:
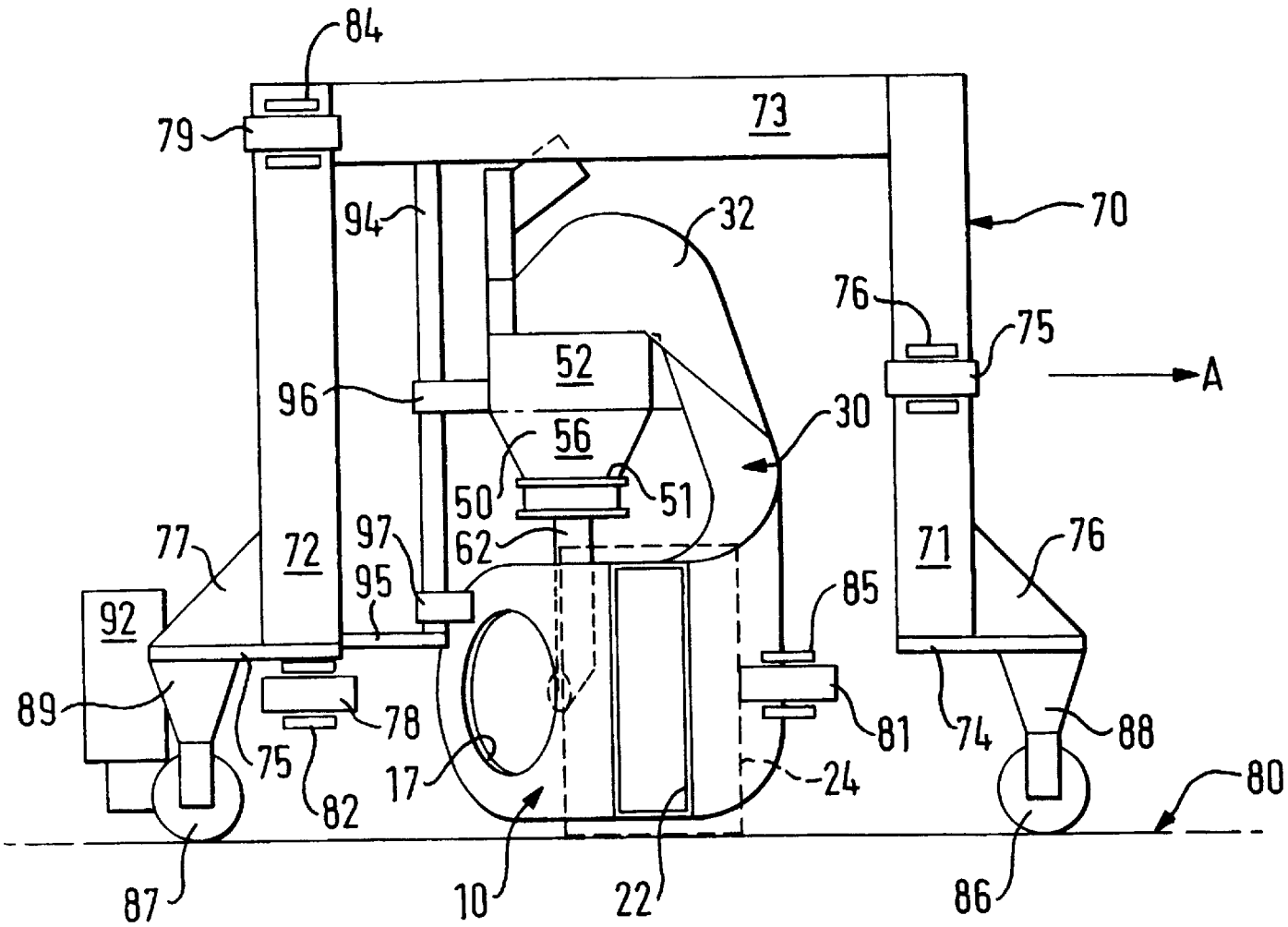
FIG. 1 is a side elevation of a surface-treatment machine.
Figure 2:
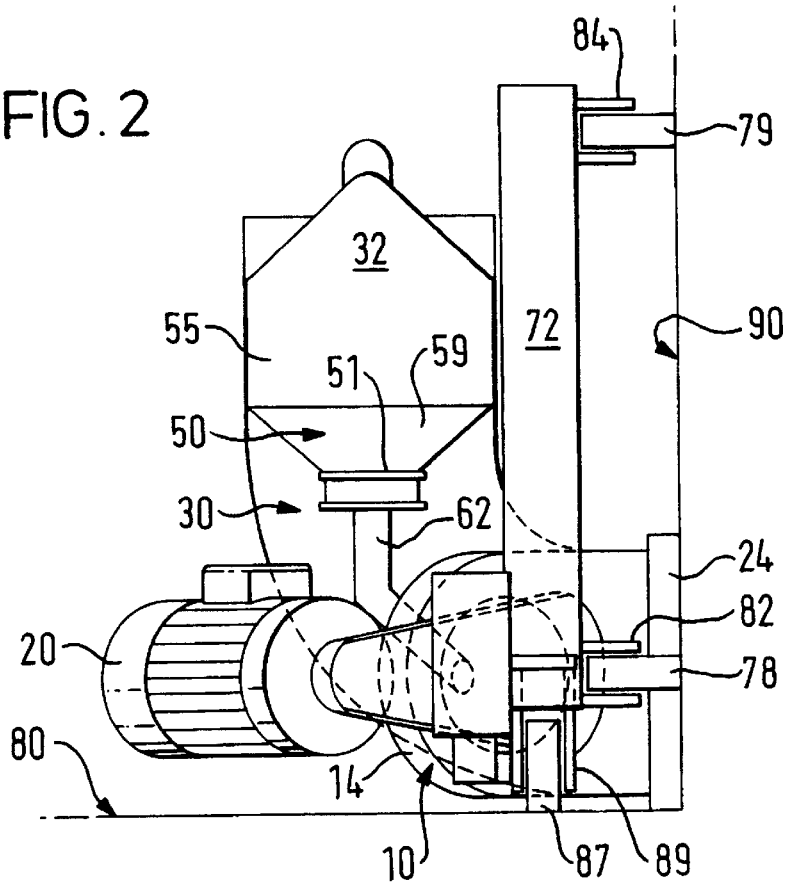
FIG. 2 is a rear elevation of the surface-treatment machine of FIG. 1.
Figure 3:
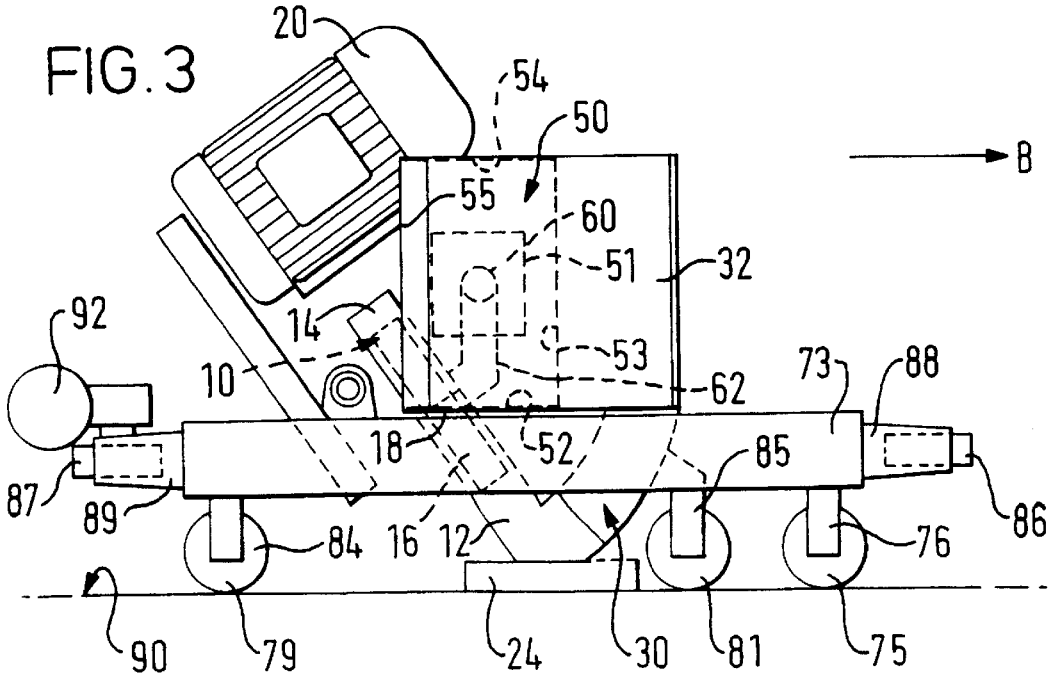
FIG. 3 is a plan view of the surface-treatment machine of FIG. 1.
Figure 4:
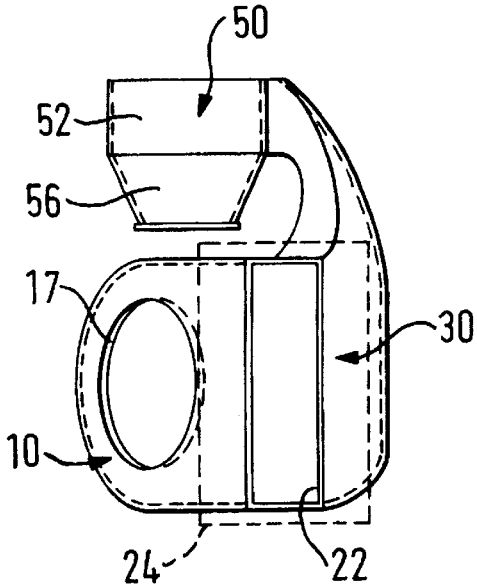
FIG. 4 is a side elevation of part of the surface-treatment machine, omitting the hood.
Figure 5:
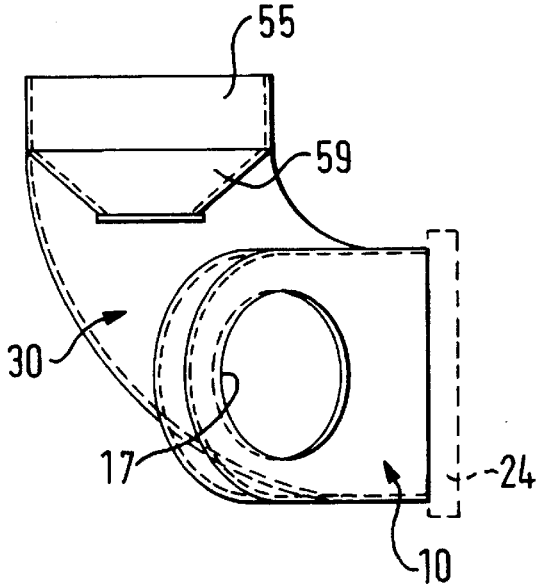
FIG. 5 is a rear elevation of the part-machine of FIG. 4.
Figure 6:
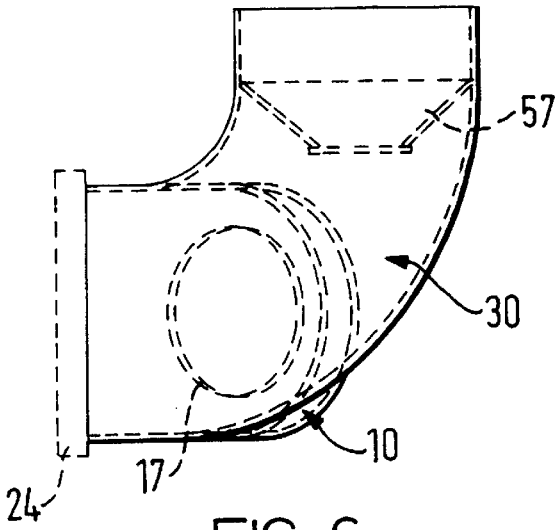
FIG. 6 is a front elevation of the part-machine of FIG. 4.
Figure 7:
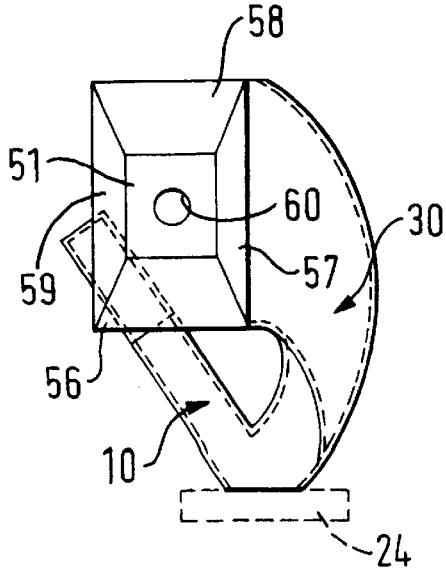
FIG. 7 is a plan view of the part-machine of FIG. 4.

Referring first to FIGS. 1 to 3 of the drawings, the machine shown consists of the following major parts: a blast housing 10, a reclaim duct 30, a reclaim hopper 50 and a support framework 70. These parts are mainly fabricated from suitable steel materials. In use, the machine is supported on a horizontal surface 80 over which it is driven and carries out a shot blasting or other operation on an adjacent vertical surface 90. The direction of travel of the machine is shown by the arrows A, B in FIGS. 1 and 3 respectively.

The blast housing 10 contains a centrifugal throwing wheel 16 which is mounted for rotation about an axis 18 which extends perpendicularly to the longitudinal axis of the duct 12. The blast housing has a rectangular cross-section about 50 mm by 250 mm from the centre of the throwing wheel 16 towards the surface 90. The portion of the housing distant from the surface 90 is curved to follow the profile of the throwing wheel, with the end of the duct being closed by a curved end wall 14. The blast housing has a circular opening 17 which allows access to the throwing wheel 16 and which is closed by a blast wheel support mount.

In the usual way, the throwing wheel 16 comprises a backplate having angularly-spaced radially-extending blades, a central impeller and a separate central cage which fits over the impeller and through which particulate material is fed to the impeller and then onto the throwing blades. The throwing wheel 16 is driven to rotate about the axis 18 by an electric motor 20, whereby particulate material introduced into the cage is projected at high speed along the blast housing by the throwing blades of the wheel.

The opposite end of the blast housing 10 leads to a rectangular opening 22 through which the vertical surface 90 is exposed to incident particulate material which is projected onto the surface by the throwing wheel 16. The opening 22 defines a rectangular area approximately 70 mm by 230 mm which is sealed around its periphery by a seal system 24 consisting of a skirt of a suitable flexible material, such as polyurethane.

The opening 22 is also in communication with one end of the reclaim duct 30 which extends to the reclaim hopper 50 along an upward spiral path as shown in the drawings. The function of the reclaim duct 30 is to receive particulate material, together with debris produced by the action of the material on the surface 90 which rebounds from the surface, and to feed the debris and particulate material to the reclaim hopper 50.

The cross-sectional area of the reclaim duct is approximately 75 mm by 250 mm at its lower end adjacent the opening 22. The central axis of the reclaim duct follows a three-dimensionally curved path which describes an upward turn through approximately 90° and also an arc of about 145° in an imaginary horizontal plane perpendicular to the vertical surface 90.

The upper end of the reclaim duct 30 is formed into a hood portion 32 which covers the upper end of the reclaim hopper 50 which, at this upper end, measures about 160 mm by 250 mm. This rectangular cross-sectional area is maintained to a depth of about 75 mm by rectangular side plates 52, 53, 54, 55 which form the upper part of the hopper. This cross-sectional area then tapers gradually to an area about 95 mm by 105 mm at the floor 51 of the hopper, the sides of the tapering part of the hopper being defined by four trapezoidal surfaces 56, 57, 58, 59.

The hopper floor 51 has a central circular opening 60 which is connected to the upper end of a feed spout 62 through which the particulate material is returned to the blast housing 10 where it is fed to the centrifugal throwing wheel 16.

The particulate material which is returned to the hopper 50 via the reclaim duct 30, with vacuum assistance, is separated from the debris from the surface 90 by air wash.

The support framework 70 comprises a U-shaped frame comprising first and second upright limbs 71,72 joined by a cross-member 73. At the lower end of each upright limb 71, 72 a foot 74, 75 is attached and extends outwardly. Triangular reinforcing plates 76,77 strengthen the joints between the limbs 71,72 and the feet 74,75.

The first upright limb 71 carries a first guide wheel 75 which is rotatably mounted in a bracket 76 and is positioned to make rolling contact with the vertical surface 80. The second upright limb 72 carries vertically-spaced second and third guide wheels 78,79 which are rotatably mounted in respective brackets 82,84 and are also positioned to make rolling contact with the vertical surface 80. A fourth wheel 81 is mounted in a bracket 85 on the reclaim duct 30. The wheels 75,78,79, 81 thus form a four-point contact arrangement with the vertical surface 90.

To each plate 74,75 a respective travel wheel 86,87 is attached by means of a suitable bracket 88,89. The travel wheels 86,87 are rotatably mounted about axes perpendicular to those about which the guide wheels 75,78,79,81 rotate. One of the travel wheels is driven by an electric travel drive motor 92. The apparatus can thus be driven over the horizontal surface 80 on which it is supported on the travel wheels 86,87.

The blast housing 10, reclaim duct 30, reclaim hopper 50 and associated components are formed as a sub-assembly which is mounted as a unit to move relative to the support framework 70. This is achieved by means of a support shaft 94 which extends parallel and adjacent to the second upright limb 72 of the support framework 70 between the cross-member 73 and a bracket 95 attached to the second upright limb. The blast housing 10 and hopper 50 have attached to them slide bearings 96,97 which receive the support shaft 94 and allow the sub-assembly of the blast housing 10, reclaim duct 30, reclaim hopper 50 and associated components to slide as a unit along the shaft 94 and thereby move relative to the support framework 70. Sliding movement is achieved by a winch. An adjusted relative position of the moveable unit and the framework is also obtained by the winch.

By the mechanism described above, the apparatus can be adjusted to treat portions of the vertical surface 90 at different heights above the horizontal surface 80, for example successive strips at increasing heights about the horizontal surface.

FIGS. 4 to 7 of the drawings show the blast housing, reclaim duct and reclaim hopper of the surface-treatment machine, without the hood 32. Some of the internal parts are thereby shown more clearly.

It should be understood that the invention is not limited to the particular embodiments shown and described herein but that various changes and modifications may be made without departing from the scope and spirit of the invention.

I claim:

1. An apparatus suitable for the treatment of a vertical surface, the apparatus comprising:

a movable housing having an opening therein for facing a surface to be treated, means within the housing for projecting particulate material out through the opening onto a said surface, and a rebound duct extending from the opening and positioned to receive particulate material rebounding from the surface after having been projected onto the surface by the material-projection means, the rebound duct extending from the opening to a means for separating rebounding particulate material from other material and returning the separated particulate material under gravity to the material-projection means, wherein, when the apparatus is orientated for treatment of a vertical surface, the material-projection means is arranged to direct incident material onto the vertical surface in a generally horizontal direction and the rebound duct is shaped to constrain rebounding material to follow a path which extends upwardly to an inlet of the separating means, whereby the rebounding material is fed to the separating means for return under gravity to the material-projection means which, in the said orientation of the apparatus, is positioned below the separating means.

2. An apparatus as claimed in claim 1, wherein the rebound duct has a spiral configuration.

3. An apparatus as claimed in claim 2, wherein the spiral reclaim duct is shaped such that the direction of rebounding material is turned through at least 90°.

4. An apparatus as claimed in claim 1, wherein the separating means includes a feed hopper into which the rebounding material issuing from the rebound duct falls under gravity when the apparatus is orientated for treatment of a vertical surface.

5. An apparatus as claimed in claim 1, including means for contacting the surface to be treated.

6. An apparatus as claimed in claim 1, including means for supporting the apparatus on a surface lying approximately perpendicular to the surface to be treated.

7. An apparatus as claimed in claim 5, wherein the contact means comprise rolling means.

8. An apparatus as claimed in claim 6, wherein the support means comprise rolling means.

9. An apparatus as claimed in claim 8, wherein the rolling means have associated drive means.

10. An apparatus as claimed in claim 1, including means whereby the height of the opening in the housing relative to a horizontal support surface can be selectively adjusted.

11. An apparatus as claimed in claim 10, wherein the adjustment means comprise a sub-assembly of the housing, reclaim duct and separating means, the sub-assembly being mounted for movement relative to a support framework and the adjustment means including means for securing the sub-assembly at a selected position relative to the support framework.

12. An apparatus as claimed in claim 11, wherein the adjustment means comprises a shaft on which the sub-assembly is slidably supported on slide bearings, and means for preventing relative sliding movement between the shaft and the bearings when a selected relative position has been achieved.

13. An apparatus suitable for the treatment of a vertical surface, the apparatus comprising:

a movable housing having an opening therein for facing a surface to be treated;

means within the housing for projecting particulate material out through the opening onto a said surface;

means for separating rebounding particulate material from other material and returning the separated particulate material under gravity to the material-projection means; and a rebound duct having a spiral configuration, extending from the opening to the separating means, and positioned to receive particulate material rebounding from the surface after having been projected onto the surface by the material-projection means;

wherein, when the apparatus is orientated for treatment of a vertical surface, the material-projection means is arranged to direct incident material onto the vertical surface in a generally horizontal direction and the rebound duct is shaped to constrain rebounding material to follow a path upwardly to an inlet of the separating means.

14. An apparatus as claimed in claim 13, wherein the spiral rebound duct is shaped such that the direction of rebounding material is turned through at least 90°.

15. An apparatus suitable for the treatment of a vertical surface, the apparatus comprising:

a movable housing having an opening therein for facing a surface to be treated, means within the housing for projecting particulate material out through the opening onto a said surface;

a rebound duct extending from the opening and positioned to receive particulate material rebounding from the surface after having been projected onto the surface by the material-projection means;

means for separating rebounding particulate material from other material and returning the separated particulate material under gravity to the material-projection means; and adjustment means whereby the height of the opening in the housing relative to a horizontal support surface can be selectively adjusted, the adjustment means comprising a sub-assembly of the housing, reclaim duct and separating means, the sub-assembly being mounted for movement relative to a support framework and the adjustment means including means for securing the sub-assembly at a selected position relative to the support framework, a shaft on which the sub-assembly is slidably supported on slide bearings, and means for preventing relative sliding movement between the shaft and the bearings when a selected relative position has been achieved;

the rebound duct extending from the opening to the separating means, and when the apparatus is orientated for treatment of a vertical surface, the material-projection means is arranged to direct incident material onto the vertical surface in a generally horizontal direction and the rebound duct is shaped to constrain rebounding material to follow a path, the rebounding material being fed to the separating means for return under gravity to the material-projection means.

* * * * *